US008083501B2

(12) United States Patent
Scarsdale

(10) Patent No.: US 8,083,501 B2
(45) Date of Patent: Dec. 27, 2011

(54) SUBSEA PUMPING SYSTEM INCLUDING A SKID WITH WET MATABLE ELECTRICAL AND HYDRAULIC CONNECTIONS

(75) Inventor: Kevin T. Scarsdale, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/268,074

(22) Filed: Nov. 10, 2008

(65) Prior Publication Data

US 2010/0119381 A1 May 13, 2010

(51) Int. Cl.
*F04B 23/04* (2006.01)
*F04B 17/03* (2006.01)

(52) U.S. Cl. ..... 417/423.3; 417/423.5; 417/423.15; 417/62

(58) Field of Classification Search ..... 417/423.3, 417/423.15, 423.5, 234; 166/338, 368, 360, 166/357; 405/169, 170, 172, 158; 137/343
See application file for complete search history.

(56) References Cited

U.S. PATENT DOCUMENTS

| | | | | |
|---|---|---|---|---|
| 2,976,256 | A * | 3/1961 | Whittier et al. | 523/450 |
| 3,319,373 | A * | 5/1967 | Gale et al. | 43/100 |
| 3,814,030 | A * | 6/1974 | Morgan, III | 108/57.25 |
| 5,273,376 | A * | 12/1993 | Ritter, Jr. | 405/169 |
| 5,518,340 | A * | 5/1996 | Hall et al. | 405/158 |
| 6,145,223 | A * | 11/2000 | Flesen | 37/317 |
| 6,394,951 | B1 * | 5/2002 | Taylor et al. | 600/210 |
| 6,443,660 | B1 * | 9/2002 | Smith et al. | 405/224 |
| 6,494,189 | B1 * | 12/2002 | Chu et al. | 123/509 |
| 6,508,308 | B1 * | 1/2003 | Shaw | 166/313 |
| 6,640,901 | B1 * | 11/2003 | Appleford et al. | 166/357 |
| 6,840,088 | B2 * | 1/2005 | Tucker et al. | 73/49.5 |
| 6,873,063 | B1 * | 3/2005 | Appleford et al. | 307/149 |
| 7,234,524 | B2 * | 6/2007 | Shaw et al. | 166/304 |
| 7,314,084 | B2 * | 1/2008 | Rodrigues et al. | 166/344 |
| 7,481,270 | B2 * | 1/2009 | Shepler | 166/105 |
| 7,534,098 | B2 * | 5/2009 | Stirling et al. | 417/423.15 |
| 7,565,932 | B2 * | 7/2009 | Lawson | 166/344 |
| 7,713,031 | B2 * | 5/2010 | Dane | 417/61 |
| 7,802,624 | B2 * | 9/2010 | Barratt | 166/338 |
| 2003/0178200 | A1 * | 9/2003 | Fox et al. | 166/341 |
| 2004/0161302 | A1 * | 8/2004 | Jarry et al. | 405/205 |
| 2004/0168811 | A1 * | 9/2004 | Shaw et al. | 166/368 |
| 2005/0186091 | A1 * | 8/2005 | Zarbi et al. | 417/362 |
| 2005/0217857 | A1 * | 10/2005 | Rodrigues et al. | 166/351 |
| 2006/0118310 | A1 * | 6/2006 | Euphemio et al. | 166/368 |
| 2006/0162934 | A1 * | 7/2006 | Shepler | 166/370 |
| 2007/0055108 | A1 * | 3/2007 | Taylor et al. | 600/210 |

(Continued)

FOREIGN PATENT DOCUMENTS

GB 2267107 A * 11/1993

(Continued)

*Primary Examiner* — Charles Freay
*Assistant Examiner* — Nathan Zollinger
(74) *Attorney, Agent, or Firm* — Jim Patterson

(57) ABSTRACT

A technique is provided for pumping fluid in subsea applications, such as booster pumping applications. A self-contained pumping module has a pump and a motor mounted on a skid. The self-contained pumping module also includes electrical connections by which electrical power can be provided to the motor and hydraulic connections for connecting suitable hydraulic lines with a pump intake and a pump discharge. The self-contained nature of the pumping module enables easy deployment to a sea floor in a variety of applications.

9 Claims, 6 Drawing Sheets

U.S. PATENT DOCUMENTS

2007/0235195 A1 10/2007 Lawson
2008/0282776 A1* 11/2008 Loeb et al. ..... 73/49.5
2009/0010783 A1* 1/2009 Appel et al. ..... 417/423.3
2009/0032301 A1* 2/2009 Smith et al. ..... 175/7
2009/0178848 A1* 7/2009 Nellessen et al. ..... 175/7
2009/0217992 A1* 9/2009 Wilson ..... 137/565.01
2009/0288836 A1* 11/2009 Goodall et al. ..... 166/336
2010/0119380 A1* 5/2010 Wilson et al. ..... 417/53

FOREIGN PATENT DOCUMENTS

GB 2419924 10/2006

* cited by examiner

SUBSEA PUMPING SYSTEM INCLUDING A SKID WITH WET MATABLE ELECTRICAL AND HYDRAULIC CONNECTIONS

BACKGROUND

In a variety of subsea applications, fluids are pumped from one region to another. For example, fluid can be produced upwardly from a subsea well, or fluid can be directed through subsea flowlines or injected into subsea wells. Sometimes existing pumping equipment is not adequate for a given task, and boosting pumps and equipment are added to the subsea equipment to facilitate the pumping applications. However, existing subsea pumping equipment used for boosting pumping capacity can be difficult and expensive to construct and/or use in the subsea environment.

SUMMARY

In general, the present application provides a system and methodology for pumping fluid in subsea applications, such as booster pumping applications. A self-contained pumping module is created by combining a pump and a motor on a skid. The self contained pumping module also comprises the electrical connections by which electric power can be provided to the motor. The pumping module further comprises a plurality of hydraulic connections for connecting suitable hydraulic lines with a pump intake and a pump discharge. The self-contained nature of the pumping module enables easy deployment to a sea floor/retrieval from the sea floor, which allows the pumping module to be deployed in a variety of applications with reduced complexity and cost.

BRIEF DESCRIPTION OF THE DRAWINGS

Certain embodiments will hereafter be described with reference to the accompanying drawings, wherein like reference numerals denote like elements, and.

DETAILED DESCRIPTION

Figure 1:
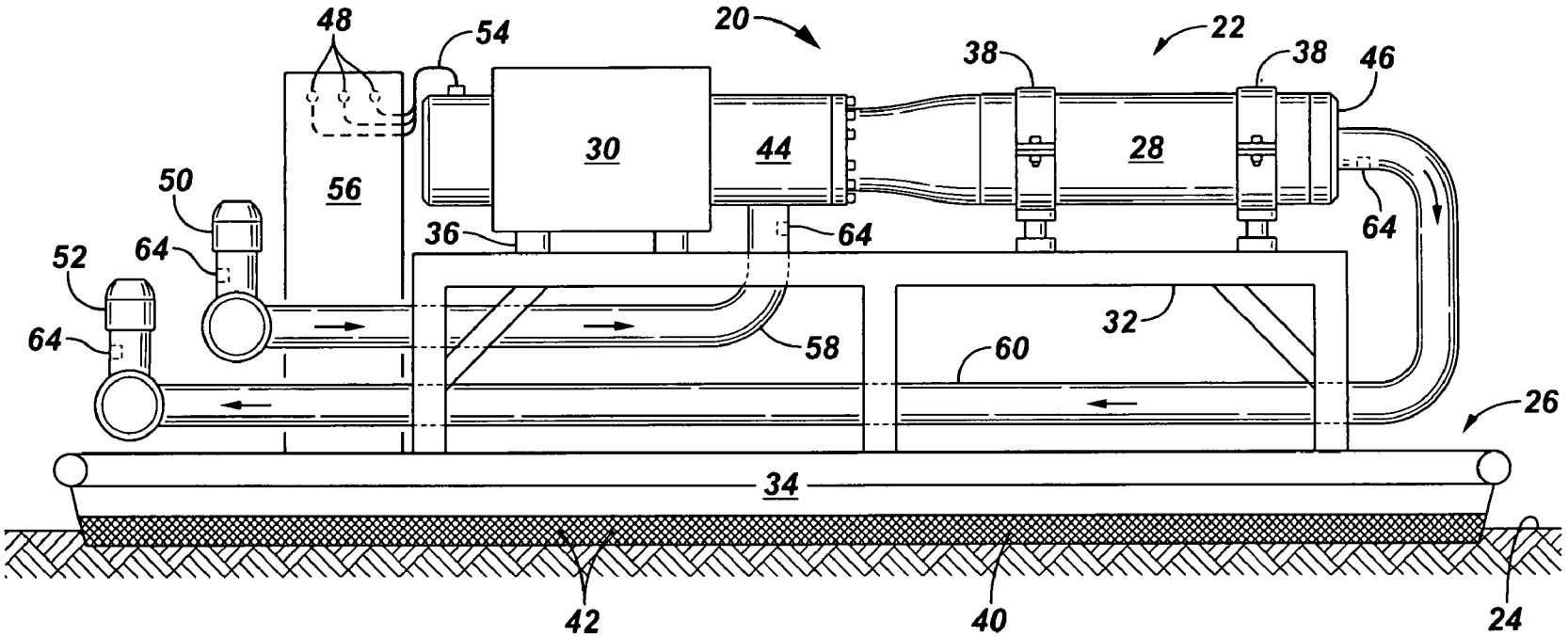
FIG. 1 is a front elevation view of one example of a self-contained pumping module, according to an embodiment.

In the following description, numerous details are set forth to provide an understanding of the present application. However, it will be understood by those of ordinary skill in the art that many embodiments may be practiced without these details and that numerous variations or modifications from the described embodiments may be possible.

The present application generally relates to a system and methodology for facilitating pumping of a fluid at a subsea location, e.g. a location proximate a subsea wellhead. The technique utilizes a self-contained pumping module that can be lowered to the sea floor and retrieved from the sea floor as a single module to provide additional pumping capacity without undue increases in time and costs. Additionally, the self-contained pumping module may have modular features that allow the pumping system to be tailored to specific application requirements.

In many applications, the self-contained pumping module is used to supplement or boost the pumping of fluids in a subsea environment. The pumping module is lowered to the sea floor where hydraulic and electrical connections are easily made by, for example, use of a remotely operated vehicle. In many applications, the pumping module is positioned directly onto the sea floor. Because of the self-contained design, positioning of the pumping module on the sea floor can be accomplished via a crane mounted on a work boat instead of requiring a work-over rig, semi-submersible platform, or drilling rig.

By way of example, the self-contained pumping module can be used in boosting fluids from subsea wells when it is not practical, feasible or desirable to install large horsepower electric submersible pumping systems or other artificial lift systems into a subsea wellbore to produce a fluid to a surface location. The self-contained pumping module can be lowered to the sea floor near a wellhead, for example, to provide boosting to a surface platform, subsea processing facility, floating production, storage and offloading vessel, or other surface locations. In some applications, the pumping module can be placed downstream of subsea processing facilities to provide lift required to produce the fluid to the surface.

Apart from production applications, the self-contained pumping module also can be positioned at the sea floor and used to inject fluid into subsea wells. For example, the pumping module can be used to inject water to facilitate pressure maintenance of a reservoir. In this type of application, the pumping module can be connected to a suitable source of water, such as drilled water source wells, subsea processing facilities, surface processing facilities, or the surrounding ocean. In other applications, the self-contained pumping module can be used in the commissioning of subsea pipelines by removing the water used to sink and hydrostatically test the subsea pipelines. In many of these types of applications, the pumping module can be used to discharge the water directly into the ocean or to deliver the water to appropriate surface or subsea facilities.

Referring generally to FIG. 1, a pumping system 20 is illustrated according to one embodiment. In this embodiment, pumping system 20 comprises self-contained pumping module 22 that can be lowered to and retrieved from a sea floor 24. The self-contained pumping module 22 may be constructed in a variety of configurations with a variety of components, and several examples are described below.

Figure 2:
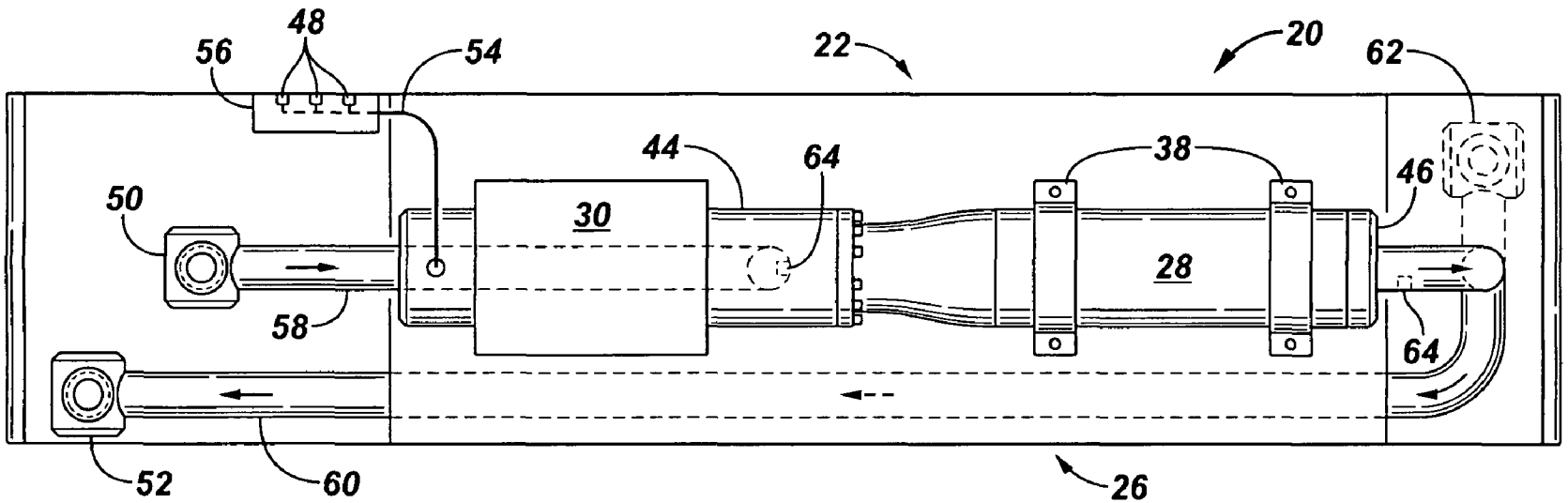
FIG. 2 is a top view of the pumping module illustrated in FIG. 1, according to an embodiment.

In the embodiment illustrated in FIGS. 1 and 2, the self-contained pumping module 22 comprises a skid 26 on which a pump 28 and a motor 30 are mounted. As illustrated, the pump 28 and the motor 30 are constructed and oriented as a horizontal pumping system. Although pump 28 and motor 30 may be mounted on skid 26 in a variety of orientations and with a variety of mechanisms, the embodiment illustrated uses a substructure or platform 32 by which the components are mounted to a base portion 34 of skid 26. By way of example, motor 30 may be mounted to substructure 32 via appropriate brackets 36, and pump 28 may be mounted to substructure 32 via appropriate clamp mechanisms 38.

The various components are designed to work in a subsea environment. For example, skid 26 may be constructed from structural steel welded or otherwise fastened together to provide a rigid base. The structural steel or other suitable component also can be painted or otherwise coated to prevent corrosion during operation in the subsea environment. Additionally, skid 26 may comprise a lower support structure 40 to secure the self-contained pumping module 22 on the sea floor. For example, support structure 40 may comprise a material or structure designed to secure the self-contained pumping module 22 in a typical seafloor constituent, such as mud or sand. In one embodiment, support structure 40 comprises a mesh material 42 constructed as a "mud mat" that securely positions pumping module 22 at a desired location in the mud/sand of the sea floor.

A variety of pumps 28 and motors 30 can be used according to the specific application requirements. Additionally, new or different types of pumps and motors can be substituted as needed based on wear or changes in the application requirements. Individual motors and pumps may be used in some applications, as illustrated in FIG. 2, however additional motors and pumps also may be incorporated into the design, as described in greater detail below.

In one embodiment, pump 28 comprises a centrifugal pump, such as a centrifugal pump used in a standard electric submersible pumping system application. Fluid enters pump 28 through an intake section 44 and passes through multiple centrifugal pumping stages that incrementally increase the fluid pressure until the fluid is discharged through a discharge head 46. By using clamp mechanisms 38, the alignment of pump 28 can be adjusted relative to intake 44 and motor 30. It should be noted that other types of pumps can be used in some applications, including helicoaxial pumps.

Motor 30 also may have a variety of forms and configurations. In the embodiment illustrated, for example, motor 30 is a three-phase induction motor. The motor is hermetically sealed to prevent contamination from the surrounding environment. Additionally, motor 30 may be pressure balanced with the surrounding environment to reduce the need for managing high differential pressures when operated in deep water. The motor 30 may be mounted horizontally such that its shaft extends through intake section 44 for direct coupling to a corresponding shaft of pump 28.

The self-contained pumping module 22 can also comprise a plurality of connectors, including electrical connectors 48 and hydraulic connectors 50 and 52. In many applications, electrical connectors 48 are wet mate connectors that enable easy connection with corresponding electric cable via, for example, a remotely operated vehicle. In the specific example illustrated, electric lines 54 are used to connect motor 30 with female receptacles of electrical wet mate connectors 48. The electrical connectors 48, in turn, are mounted in a structure 56, such as a stab plate secured to skid 26. The stab plate may be mounted at various locations along the edge of the skid 26 or at other suitable locations that enable easy connection with a subsea power grid or other source of power.

Similarly, hydraulic connectors 50, 52 may be formed as hydraulic wet mate connectors that enable easy connection of hydraulic lines via, for example, a remotely operated vehicle. In the embodiment illustrated, hydraulic connector 50 is coupled with pump intake section 44 via flow tubing 58, and hydraulic connector 52 is coupled with pump discharge head 46 via flow tubing 60. The hydraulic connectors 50, 52 can be located at the same end of skid 26 or at other suitable locations along the pumping module 22. For example, an optional discharge hydraulic connector 62 is illustrated by dashed lines in FIG. 2. The hydraulic inlet connector 50 may be connected to piping that extends directly from a subsea wellhead, a subsea processing facility, a subsea pipeline, or another subsea structure carrying fluid for which boosted fluid flow is desired.

In a variety of applications, various instrumentation 64 also can be added to self-contained pumping module 22 to monitor parameters related to the pumping operation. For example, the instrumentation 64 may comprise sensors, such as temperature sensors, pressure sensors, flow rate sensors and other sensors. The instrumentation 64 also may include other components, such as control modules used to provide feedback and/or to control specific functions, such as the opening and closing valves.

Figure 3:
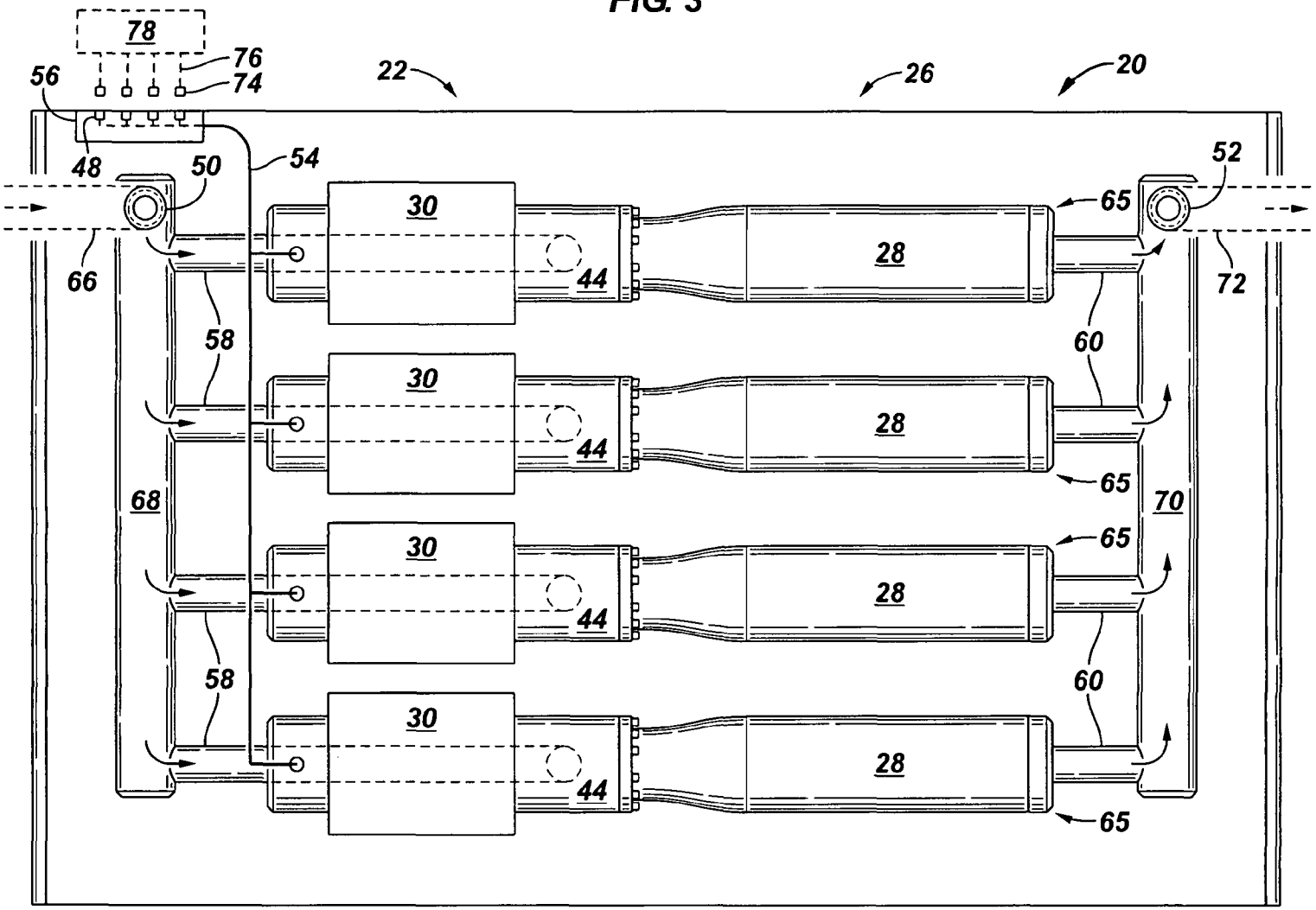
FIG. 3 is another example of the self-contained pumping module, according to an alternate embodiment.

Referring generally to FIG. 3, another embodiment of self-contained pumping module 22 is illustrated. In this embodiment, the pumping module 22 comprises a plurality of pumps 28 and a plurality of motors 30. By way of example, individual motors 30 can be connected with individual corresponding pumps 28 to create a series of combined motors and pumps arranged as individual pumping units 65. The groupings of motors and pumps are combined on a single skid 26 to enable increased system flexibility and to allow for redundant pumping systems. In the embodiment of FIG. 3, for example, the series of motors 30 and corresponding pumps 28 comprise four individual pump/motor units 65 mounted in parallel. During operation of pumps 28, fluid is drawn in through a supply tubing 66 that is coupled with hydraulic connector 50. The supplied fluid flows through hydraulic connector 50 and into an intake manifold 68 that supplies the individual intake tubes 58 for the plurality of pumps 28. Once the fluid is discharged by the pumps 28, the fluid flows into a discharge manifold 70, out through hydraulic connector 52, and subsequently through an outflow tubing 72.

The plurality of motors 30 can be supplied with electrical power via electric lines 54 which may be in the form of electric cables or an electric bus connected to structure 56. Electrical power is supplied to wet mate electrical connectors 48 in structure 56 via corresponding wet mate connectors 74 carried on electric supply cables 76. The electric power supplied is controlled by a control system 78 which can be located top side, on a floating production, storage and offloading vessel, on a production platform, or at a subsea location. The control system 78 can be designed to control any of the various embodiments of self-contained pumping module 22. Additionally, the control system 78 can be used for receiving and/or outputting data with respect to instrumentation 64.

Figure 4:
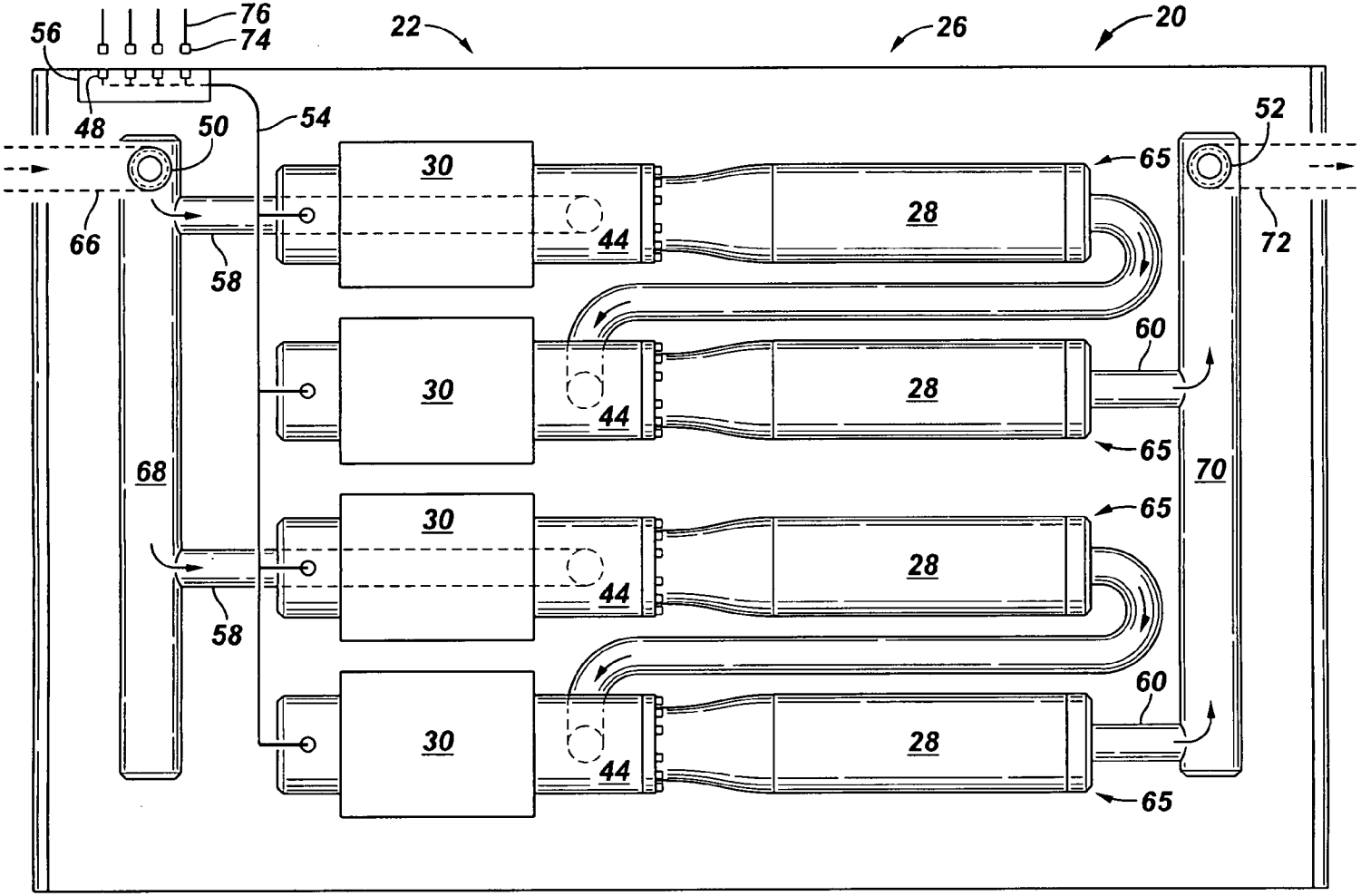
FIG. 4 is another example of the self-contained pumping module, according to an alternate embodiment.

Another embodiment of self-contained pumping module 22 is illustrated in FIG. 4. In this embodiment, a plurality of motors 30 and pumps 28 are again arranged in individual pumping units 65. In the particular example illustrated, four pumping units 65 are mounted on skid 26 with pairs of the pumping units 65 connected in series to provide twice the boost pressure of a single pumping unit. The two pairs of pumping units 65 are then operated in parallel, via connections to intake manifold 68 and discharge manifold 70, to provide twice the flow rate relative to a single pair of the pumping units 65 connected in series.

Figure 5:
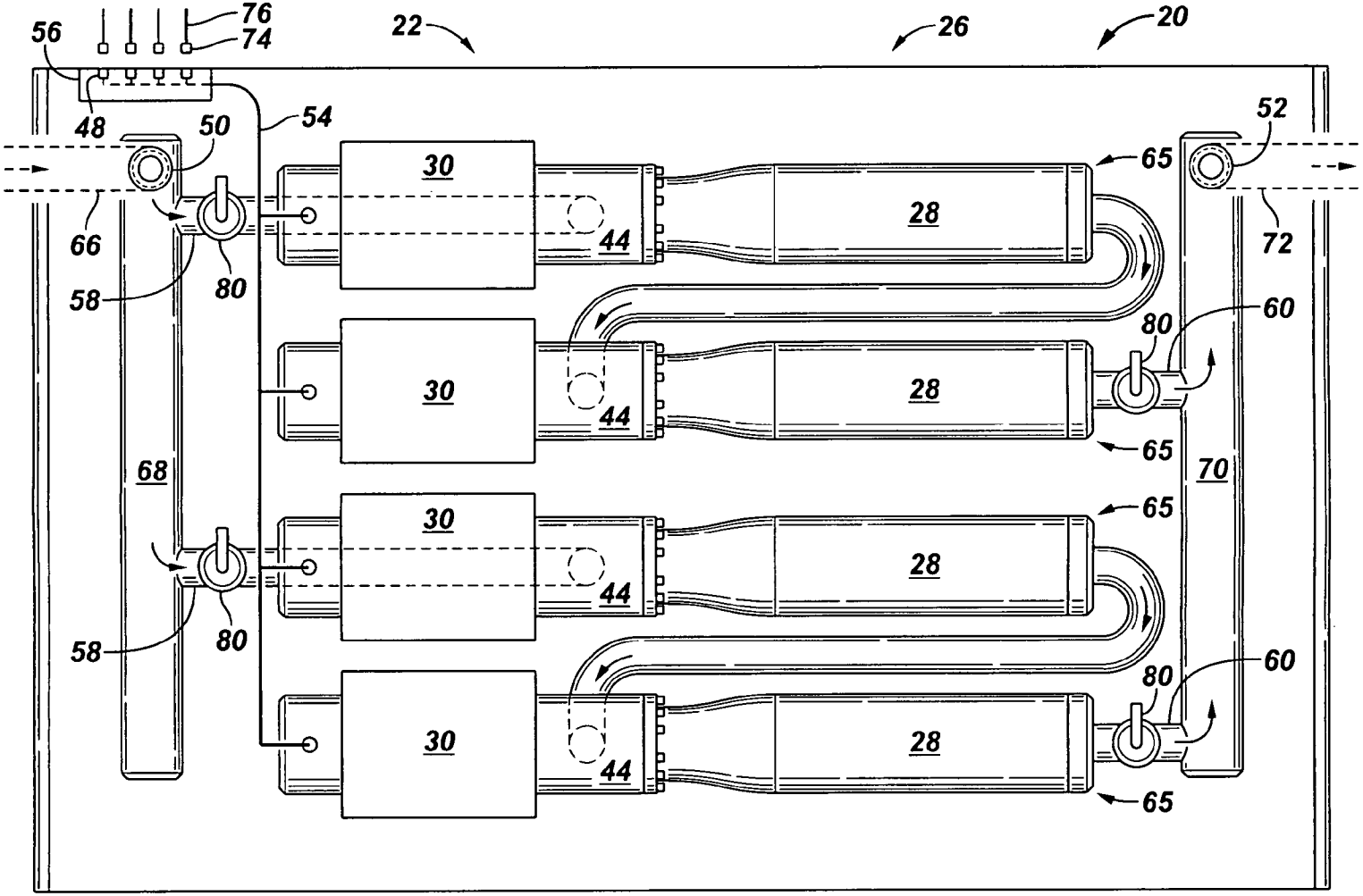
FIG. 5 is another example of the self-contained pumping module, according to an alternate embodiment.

Referring generally to FIG. 5, another embodiment of self-contained pumping module 22 is illustrated. The illustrated embodiment is similar to the embodiment of FIG. 4, however a plurality of isolation valves 80 have been added. The isolation valves 80 allow one pair of pumping units 65 to operate, while the other is available as a back-up in case the first pair fails to function as desired. In the embodiment illustrated in FIG. 5, the isolation valves 80 are positioned in the pair of intake tubings 58 coupled with intake manifold 68, and in the pair of outflow tubings 60 coupled with discharge manifold 70. However, the isolation valves 80 can be used in a variety of other self-contained pumping module embodiments. For example, isolation valves can be used in the embodiment illustrated in FIG. 3 to make all four pumping units 65 capable of independent operation.

Figure 6:
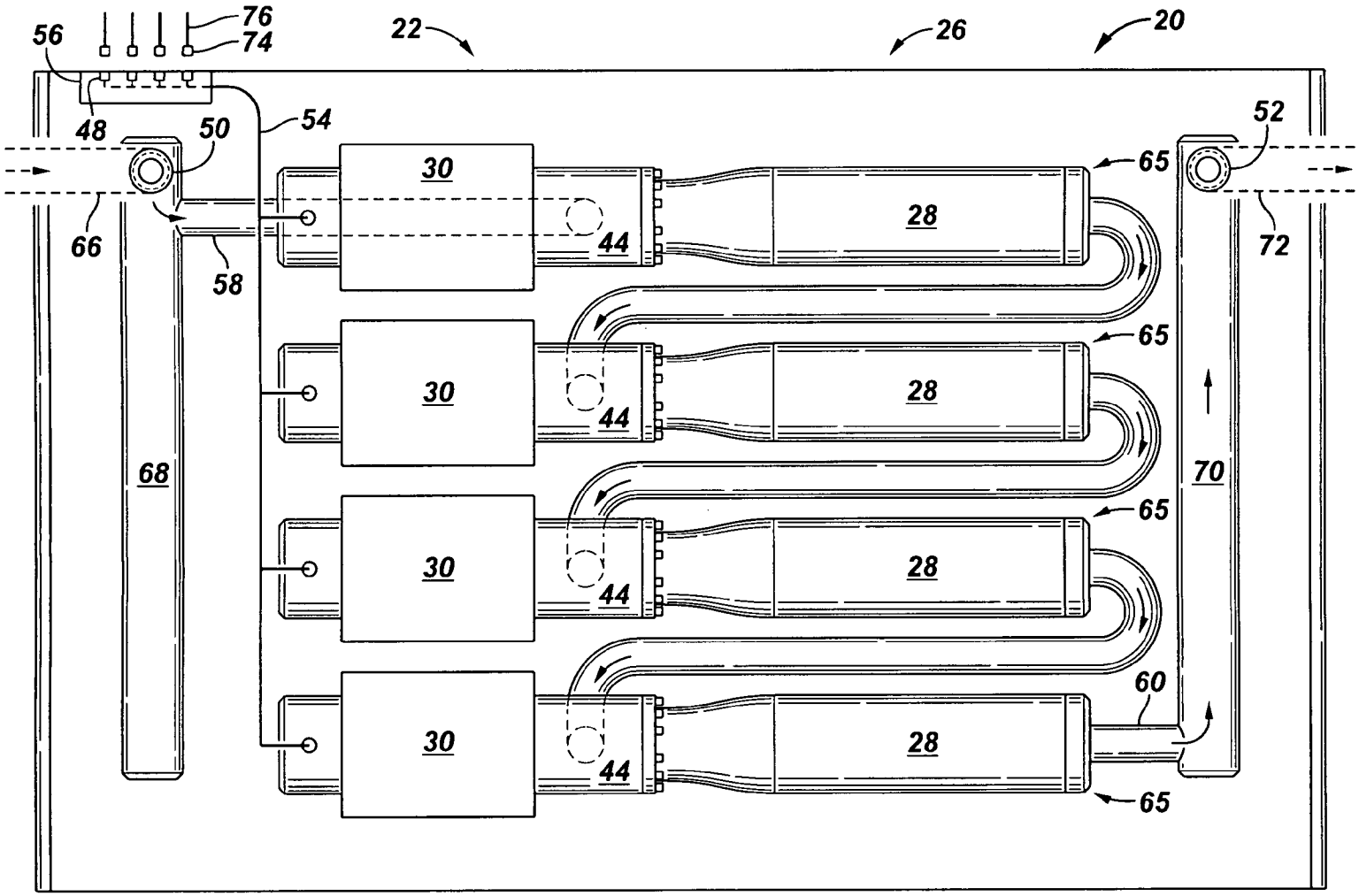
FIG. 6 is another example of the self-contained pumping module, according to an alternate embodiment.

Referring generally to FIG. 6, another embodiment of self-contained pumping module 22 is illustrated. In this embodiment, a plurality of motors 30 and a plurality of pumps 28 are mounted on skid 26 and arranged in pumping units 65 that are connected in series. In the specific example illustrated, four pumping units 65 are connected in series, although the number of pumping units can be varied according to the requirements of a given application. The four pumping units connected in series provide four times the discharge pressure at a given flow rate.

The size, configuration, and component types used to construct self-contained pumping module 22 can be varied to accommodate many types of subsea pumping applications, including boosting production and injection applications. An individual motor and pump can be mounted on the skid, or a plurality of motors and pumps can be mounted on the skid in many configurations, including parallel configurations, serial configurations, and numerous combinations of parallel and serial configurations. Additionally, the materials and structure of skid 26 and support structure 40 can be selected to accommodate easy positioning of the self-contained pumping module 22 directly onto seafloor 24. The skid 26 can be deployed to many locations for use in a variety of subsea pumping applications, including the boosting of fluid flow from subsea wells. Similarly, the position and configuration of the wet mate connectors, both hydraulic and electrical, can vary from one application to another to accommodate easy connection of electric lines and hydraulic lines.

Although only a few embodiments have been described in detail above, those of ordinary skill in the art will readily appreciate that many modifications are possible. Such modifications are intended to be included within the scope of the claims.

What is claimed is:

1. A pumping system for boosting fluid flow at a subsea location, comprising:

a self-contained pumping module having a plurality of components mounted in a single module so the self-contained pumping module can be lowered to a position resting on the seafloor in a single trip and retrieved from the seafloor in a single trip, the plurality of components comprising:

a skid;

a plurality of pumps mounted on the skid in a generally horizontal orientation;

a plurality of motors mounted on the skid, each motor of the plurality of motors being coupled to a corresponding pump of the plurality of pumps to increase flow rate, discharge pressure, or both flow rate and discharge pressure;

an electrical stab plate mounted on the skid and comprising a plurality of wet matable connections through which electric power is provided to the plurality of motors; and a plurality of hydraulic connections in fluid communication with the plurality of pumps, the plurality of hydraulic connections being wet matable independently of the wet matable connections of the electrical stab plate and at a location separate from the wet matable connections of the electrical stab plate to enable easy connection of independent hydraulic lines.

2. The pumping system as recited in claim 1, wherein the self-contained pumping module further comprises a mesh material positioned to engage a seafloor.

3. The pumping system as recited in claim 1, wherein the skid is constructed from coated steel.

4. The pumping system as recited in claim 1, wherein the plurality of pumps comprises a plurality of centrifugal pumps.

5. The pumping system as recited in claim 1, wherein the plurality of motors comprises a plurality of three phase induction motors, the motors being hermetically sealed.

6. The pumping system as recited in claim 1, wherein at least two pumps of the plurality of pumps are connected in parallel.

7. The pumping system as recited in claim 1, wherein at least two pumps of the plurality of pumps are connected in series.

8. The pumping system as recited in claim 1, wherein at least two pumps of the plurality of pumps are connected in parallel, and at least two pumps of the plurality of pumps are connected in series.

9. The pumping system as recited in claim 1, wherein the self-contained pumping module further comprises at least one isolation valve positioned between pumps of the plurality of pumps.

* * * * *